US011195709B2

(12) United States Patent
Jones et al.

(10) Patent No.: US 11,195,709 B2
(45) Date of Patent: Dec. 7, 2021

(54) AMBIENT IONISATION SOURCE UNIT

(71) Applicant: MICROMASS UK LIMITED, Wilmslow (GB)

(72) Inventors: Emrys Jones, Manchester (GB); Steven Derek Pringle, Darwen (GB); Michael Raymond Morris, Glossop (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/604,461

(22) PCT Filed: Apr. 11, 2018

(86) PCT No.: PCT/GB2018/050960

§ 371 (c)(1),
(2) Date: Oct. 10, 2019

(87) PCT Pub. No.: WO2018/189534

PCT Pub. Date: Oct. 18, 2018

(65) Prior Publication Data

US 2020/0152436 A1 May 14, 2020

(30) Foreign Application Priority Data

| | | |
|---|---|---|
| Apr. 11, 2017 | (GB) | 1705864 |
| Jun. 2, 2017 | (GB) | 1708835 |
| Mar. 26, 2018 | (GB) | 1804803 |

(51) Int. Cl.

| | |
|---|---|
| ***H01J 49/00*** | (2006.01) |
| ***H01J 49/04*** | (2006.01) |
| ***H01J 49/16*** | (2006.01) |

(52) U.S. Cl.

CPC ..... *H01J 49/045* (2013.01); *H01J 49/0013* (2013.01); *H01J 49/0463* (2013.01); *H01J 49/165* (2013.01)

(58) Field of Classification Search

CPC .. H01J 49/045; H01J 49/0013; H01J 49/0463; H01J 49/165; H01J 49/0445;

(Continued)

(56) References Cited

U.S. PATENT DOCUMENTS 4,766,313 A * 8/1988 Homma ..... H01J 37/252 250/289
5,118,937 A * 6/1992 Hillenkamp ..... G01N 27/44704 250/282

(Continued)

FOREIGN PATENT DOCUMENTS

EP 0964427 A2 12/1999
GB 2491486 A 12/2012

(Continued)

OTHER PUBLICATIONS

Search Report for GB Patent Application No. GB1705864.5, dated Sep. 27, 2017, 3 pages.

(Continued)

*Primary Examiner* — Michael Maskell

(74) *Attorney, Agent, or Firm* — Kacvinsky Daisak Bluni PLLC

(57) ABSTRACT

An ambient ionisation source unit (10) is provided comprising: a housing (12) containing a first device (14) for generating analyte material from a surface of a sample to be analysed and a sampling inlet (16) for receiving analyte material liberated from the surface of the sample. The position(s) of the first device and/or sampling inlet is (are) fixed relative to the housing. Thus, the first device and the sampling inlet are integrated into a single unit that can be installed onto the front-end of an ion analysis instrument with minimal or reduced user interaction.

14 Claims, 9 Drawing Sheets

(58) Field of Classification Search
CPC ..... H01J 49/16; H01J 49/142; H01J 49/0459; H01J 49/164
USPC ..... 250/281, 282, 288
See application file for complete search history.

(56) References Cited

U.S. PATENT DOCUMENTS

| | | | | |
|---|---|---|---|---|
| 7,196,525 | B2 * | 3/2007 | Sparkman | H01J 49/0004 324/464 |
| 2004/0217283 | A1 * | 11/2004 | Bai | H01J 49/164 250/288 |
| 2007/0228271 | A1 | 10/2007 | Truche et al. | |
| 2008/0156985 | A1 * | 7/2008 | Venter | H01J 49/165 250/288 |
| 2009/0121127 | A1 * | 5/2009 | Orlando | H01J 49/142 250/282 |
| 2010/0059674 | A1 | 3/2010 | Chen et al. | |
| 2010/0072359 | A1 * | 3/2010 | Briglin | H01J 49/0459 250/282 |
| 2010/0078550 | A1 | 4/2010 | Wiseman et al. | |
| 2011/0049352 | A1 * | 3/2011 | Ding | H01J 49/0463 250/282 |
| 2011/0220784 | A1 | 9/2011 | Roach et al. | |
| 2012/0080592 | A1 | 4/2012 | Wiseman et al. | |
| 2016/0126080 | A1 | 5/2016 | Kertesz et al. | |
| 2017/0135613 | A1 * | 5/2017 | Cooks | H01J 49/167 |

FOREIGN PATENT DOCUMENTS

| | | | |
|---|---|---|---|
| GB | 2507297 | A | 4/2014 |
| JP | 2007165116 | A | 6/2007 |
| WO | 2005094389 | A2 | 10/2005 |
| WO | 2007/140349 | A2 | 12/2007 |
| WO | 2008008826 | A2 | 1/2008 |
| WO | 2008097831 | A1 | 8/2008 |
| WO | 2009070555 | A1 | 6/2009 |
| WO | 2011022364 | A1 | 2/2011 |
| WO | 2012167183 | A1 | 12/2012 |
| WO | 2016142674 | A1 | 9/2016 |
| WO | 2016142683 | A1 | 9/2016 |
| WO | 2016142685 | A1 | 9/2016 |
| WO | 2016142690 | A1 | 9/2016 |

OTHER PUBLICATIONS

International Search Report and Written Opinion for International Patent Application No. PCT/GB2018/050959, dated Jul. 9, 2018, 12 pages.
Haddad, R., et al., "Desorption Sonic Spray Ionization for (High) Voltage-Free Ambient Mass Spectrometry", Rapid Commun. Mass Spectrom., 20:2901-2905 (2006).
Hirabayashi, A., et al., "Sonic Spray Mass Spectrometry", Anal. Chem., 67:2878-2882 (1995).
Pagnotti, V S , et al., "Solvent Assisted Inlet Ionization: An Ultrasensitive New Liquid Introduction Ionization Method for Mass Spectrometry", Anal. Chem., 83:3981-3985 (2011).
Compton, L. R., et al., "Remote Laser Ablation Alectrospray Ionization Mass Spectrometry for Non-Proximate Analysis of Biological Tissues", Rapid Commun. Mass Spectrom., 29:67-73 (2015).
Luo, Z , et al., "Air Flow-Assisted Ionization Imaging Mass Spectrometry Method for Easy Whole-Body Molecular Imaging under Ambient Conditions", Anal. Chem., 85:2977-2982 (2013).
He, J., et al., "Air Flow Assisted Ionization for Remote Sampling of Ambient Mass Spectrometry and its Application", Rapid Commun. Mass Spectrom., 25:843-850 (2011).
Trimpin, S., ""Magic" Ionization Mass Spectrometry", J. Am. Soc. Mass Spectrom., 27:4-21 (2016).
Combined Search and Examination Report for United Kingdom Application No. GB1804803.3, dated Sep. 26, 2018, 9 pages.
International Search Report and Written Opinion for International Application No. PCT/GB2018/050960, dated Sep. 5, 2018, 19 pages.
Search Report for United Kingdom Application No. GB1708835.2, dated Dec. 1, 2017, 3 pages.
Takats, Z., et al., "In Situ Desorption Electrospray Ionization (DESI) Analysis of Tissue Sections",Cold Spring Habor Protocols, 3 (4):1-4, Apr. 2008.
Wiseman, J. M., et al.,"Mass Spectrometric Profiling of Intact Biological Tissue by Using Desorption Electrospray Ionisation", Angewandte Chemie International Edition, 44(43):7094-7097 (2005).
International Search Report and Written Opinion for International Patent Application No. PCT/GB2018/051508, dated Sep. 17, 2018, 15 pages.
Takats et al., "Ambient Mass Spectrometry Using Desorption Electrospray Ionization (DESI): Instrumentation, Mechanisms and Applications in Forensics, Chemistry, and Biology", Journal of Mass Spectrometry, Wiley, Chichester, GB, 40(10):1261-1275, Oct. 1, 2005.
Asano, K. G., et al., "Self-aspirating Atmospheric Pressure Chemical Ionization Source for Direct Sampling of Analytes an Surfaces and in Liquid Solutions", Rapid Communications in Mass Spectrometry, 19:2305-2312 (2005).
Forbes, T. P., et al., "Desorption Electro-Flow Focusing Ionization of Explosives and Narcotics for Ambient Pressure Mass Spectrometry", Analyst, 138:5665-5673 (2013).
Search Report for United Kingdom Application No. GB1804803.3, dated Oct. 7, 2019, 2 pages.
CNOA for Application No. 201880019342.4 dated May 8, 2021, 7 pages.
Examination Report under Section 18(3) for Application No. GB1708835.2, dated May 6, 2021, 7 pages.
Examination Report under Section 18(3) for Application No. GB1804803.3, dated Dec. 18, 2020, 4 pages.
Examination Report under Section 18(3) for Application No. GB1705864.5, dated Mar. 24, 2021 4 pages.
Combined Search and Examination Report under Sections 17 and 18(3), for Application No. GB2107250.9, dated Jun. 24, 2021, 7 pages.

* cited by examiner

AMBIENT IONISATION SOURCE UNIT

CROSS-REFERENCE TO RELATED APPLICATION APPLICATIONS

This application is a national phase filing claiming the benefit of and priority to International Patent Application No. PCT/GB2018/050960, filed on Apr. 11, 2018, which claims priority from and the benefit of United Kingdom Patent Application No. 1708835.2 filed on Jun. 2, 2017, United Kingdom Patent Application No. 1705864.5 filed on Apr. 11, 2017, and United Kingdom Patent Application No. 1804803.3 filed on Mar. 26, 2018. The entire contents of these applications are incorporated herein by reference.

FIELD OF THE INVENTION

The present invention relates generally to systems and methods for mass and/or ion mobility spectrometry, and in particular to ambient ionisation sources and source units for use with the same.

BACKGROUND

Various ambient ionisation techniques have been developed in recent years for use in mass and/or ion mobility spectrometry wherein analyte material is generated, and in some cases ionised, outside of the instrument under ambient (atmospheric) conditions and typically without any significant sample preparation or separation. For instance, analyte material may be desorbed or ablated directly from the surface of a sample with the resulting analyte material liberated from the surface then being collected ('sampled) and passed towards an inlet of a mass or ion mobility spectrometer for analysis. The liberated analyte material may already contain ions that can be analysed or the analyte material may be subject to a further step of ionisation or secondary ionisation as it is passed to the analysis instrument.

Ambient ionisation techniques such as desorption electrospray ionisation ('DESI') can, when properly optimised, provide very rich data sets. Furthermore, in terms of imaging or surface sampling methods, ambient ionisation may have various advantages compared to traditional techniques such as matrix-assisted laser desorption ionisation ('MALDI') wherein the sample preparation steps may take a significant amount of time rendering them unsuitable for some applications.

However, there are currently some barriers to greater acceptance and uptake of such techniques.

SUMMARY

According to a first aspect of the present disclosure there is provided an ambient ionisation source unit comprising:

a housing containing a first device for generating analyte material from a surface of a sample to be analysed and a sampling inlet for collecting analyte material liberated from the surface of the sample, wherein the position(s) of the first device and/or sampling inlet is (are) fixed relative to the housing.

Thus, at least according to some embodiments described herein, an ambient ionisation source unit is provided wherein the position(s) of the first device and/or sampling inlet is (are) fixed within the housing. In other words, the first device and the sampling inlet are integrated into a single sampling head or probe unit (i.e. 'source unit'). In this way, the requirement for manual user optimisation or set-up of such components may be reduced or avoided. By contrast, the set-up for conventional ambient ionisation sources can often be long and laborious, potentially negating the time saved by the absence of the sample preparation step. This requirement for manual optimisation can also lead to significant variation in results. The ambient ionisation source unit described herein may therefore offer improved ease of use, robustness and performance (reproducibility) compared to conventional ambient ionisation source set-ups.

For instance, the first device and/or sampling inlet may be fixed within the housing of the source unit in a substantially optimal geometry. For example, substantially optimal positions for the first device and/or sampling inlet may be determined based on a prior calibration experiment (or may otherwise be known or determined). The geometry can thus be fixed (e.g. during manufacture) so that the source unit need not (and cannot) subsequently be adjusted by a user.

In some embodiments, only one of the first device and sampling inlet is fixed within the housing. For example, the first device may be fixed whereas the sampling inlet can still be adjusted. For instance, the sampling inlet may be adjustable between two or more discrete positions (e.g. orientations), so that the ambient ionisation source unit can be operated in two or more discrete modes, each mode having a different pre-determined geometry. In this case it will be appreciated that the requirements for user set-up or optimisation may still be reduced. However, in other embodiments, the positions of both the first device and sampling inlet are fixed relative to the housing (and hence the position of the first device is also fixed relative to the sampling inlet). In this case, the only remaining geometric degrees of freedom may be the height and/or position of the source unit relative to the sample.

The first device and sampling inlet may be separately mounted (fixed) to the housing so that the positions of the first device and sampling inlet can be independently set and optimised relative to the housing.

The ambient ionisation source unit thus comprises a combined first device and sampling inlet that may be connected (in use) to the front-end of an ion analysis instrument such as mass and/or ion mobility spectrometer. The ambient ionisation source "unit" effectively thus provides a standalone cartridge that may be rapidly installed (and replaced) onto an ion analysis instrument as desired with minimal or reduced user interaction or set-up required. The fixed geometry may help to ensure reproducibility between units, and thus between different users.

The source unit is generally configured for analysing samples under ambient conditions. That is, the source unit is generally an "ambient ionisation" source unit. It will be appreciated that "ambient ionisation" refers to various techniques wherein analyte material is liberated from a sample surface under ambient i.e. atmospheric conditions (in contrast to conventional ionisation sources which often operate under partial vacuum or sealed conditions). Typically, ambient ionisation techniques can be performed on native samples without requiring any significant sample preparation or separation steps. That is, ambient ionisation techniques are generally capable of generating gas-phase analyte material directly from native (i.e. untreated or unmodified) samples. A particular benefit of ambient ionisation techniques is therefore that they do not require any prior sample preparation.

The first device is configured to interact with, e.g. provide energy to, a sample in use in order to liberate analyte material. Particularly, the first device may be configured to direct or focus energy towards a sampling spot (e.g. on the surface of a sample to be analysed). The first device may be configured to be brought into close proximity or otherwise engaged with a sample to be analysed to generate analyte material. The first device may therefore generally comprise (or be referred to) as a "sampling probe".

The first device thus acts to liberate analyte material from the surface of the sample. The analyte material that is liberated from the sample may generally comprise any of an aerosol, smoke, vapour or droplets (droplet stream) and/or analyte ions. The liberated analyte material may contain ions already that are suitable for analysis but it is also contemplated that the first device may simply generate a mixture of particles which are then subject to further ionisation either within the ambient ionisation source unit or within an ion source region of an instrument to which the ambient ionisation source unit is connected.

The first device may comprise any suitable and desired ambient sampling probe. For example, the first device may comprise a laser ablation probe. The first device may thus act to direct a laser beam onto a surface of a sample to be analysed wherein the laser beam may act to ablate material from the sample surface which ablated material may then be collected by the sampling inlet (so that it may then be transferred to an ion analysis instrument for analysis). The first device may thus be engaged with the sample by directing the laser beam (produced by a laser, which may be provided within the housing but typically is provided outside of the housing with the laser beam being coupled into the housing via a suitable (e.g. fibre-optic or waveguide) connection) onto the sample to generate analyte material, e.g. so as to generate aerosol, smoke, vapour or droplets and/or analyte ions from the sample.

As another example, the ambient ionisation source unit may comprise a plasma desorption probe.

However, in embodiments, the first device comprises a sprayer device. Particularly, the first device may comprise a sprayer device that acts to direct a pneumatic spray of solvent droplets onto a surface of a sample to be analysed. The sprayer device may thus generally comprise a spray capillary (or "nebuliser") for generating a pneumatic spray of solvent droplets.

The solvent droplets may be charged (although need not be). For instance, a voltage may be applied to the sprayer device in order to charge the solvent or the solvent droplets. For example, the sprayer device may comprise a spray capillary, as in a conventional electrospray ionisation ("ESI") type source, and a voltage between about 0 and 5 kV may be applied to the spray capillary in order to charge the solvent droplets. In embodiments, voltages between about 2 and 3 kV, such as voltages of about 2.5 kV, may suitably be applied to the spray capillary. However, it will be appreciated that the solvent droplets may be charged in other ways. Also, in some embodiments, the solvent droplets may not be charged by the sprayer device. For instance, the sprayer device may suitably be configured to perform sonic spray ionisation.

Liquid solvent may be provided to the sprayer device at a solvent flow rate between about 0.05 and 10 μL/min. In embodiments, the solvent flow rate may be between about 1 and 4 μL/min, such as between about 2 and 3 μL/min, or about 2 μL/min.

The solvent may comprise any suitable and desired solvent. For example, the solvent may comprise an organic solvent such as acetonitrile. Where the solvent comprises acetonitrile, the solvent may comprise a ratio by volume of acetonitrile:water of between about 50:50 and 90:10, such as between about 60:40 and 90:10, such as between about 70:30 and 90:10, such as about 80:20. As another example, the solvent may comprise methanol. In that case, the solvent may comprise a ratio by volume of methanol:water of between about 80:20 or 90:10 to about 99:1. Other suitable and electrospray compatible solvents may include dichloromethane (optionally mixed with methanol), dichloroethane, tetrahydrofuran, ethanol, propanol, nitromethane, toluene (optionally mixed with methanol or acetonitrile), or water. The solvent may further comprise an acid such as formic or acetic acid. For example, the solvent may comprise between about 0.2 and 0.4% by volume acid.

The solvent may further comprise one or more additives for enhancing the generation of multiply charged species. For example, the solvent may comprise as additives DMSO or 3-NBA. Other suitable additives may include volatile salts or buffers such as ammonium acetate or ammonium bicarbonate. Various other additives including dimethylformamide (DMF), trifluoroacetic acid, heptafluorobutyric acid, sodium dodecyl sulphate, ethylenediaminetetraacetic acid, and involate salts or buffers such as sodium chloride and sodium phosphates may also be added. A lock mass compound may also be added e.g. for calibration correction.

The spray of solvent droplets may be generated using a nebulizing gas provided to the sprayer device. The nebulizing gas may suitably be provided at a pressure between about 1 and 10 bar such as between about 3 and 5 bar, such as about 4 bar.

For instance, the first device may comprise a desorption electrospray ionisation ('DESI') sprayer device, a nano-DESI sprayer device, or similar. The DESI technique is described for instance in R. Crooks et al. "Mass Spectrometry Sampling Under Ambient Conditions with Desorption Electrospray 30 Ionisation", *Science,* 2004, 306, 471-473. Some examples of related techniques derived from DESI that may also be suitably be used in accordance with various embodiments are described in a survey article "Ambient Mass Spectrometry", *Science,* 2006, 311, 1566-1570. DESI is also described in various patents and patent publications including U.S. Pat. No. 7,847,244 (PURDUE RESEARCH FOUNDATION), U.S. Pat. No. 8,203,117 (PROSOLIA, INC.) and U.S. Pat. No. 7,335,897 (PURDUE RESEARCH FOUNDATION).

The DESI technique allows for ambient ionisation of a trace sample at atmospheric pressure with little (or no) sample preparation. In these embodiments, where the sprayer device comprises a DESI (or similar) sprayer device, a spray of (primary) electrically charged droplets may be directed onto the surface of the sample. Subsequent ejected (e.g. splashed) (secondary) droplets may carry desorbed ionised analytes (e.g. desorbed lipid ions).

Thus, as described above, the sprayer device may be supplied with a solvent, a nebulising gas such as nitrogen, and a voltage from a voltage source. The solvent may be supplied to a central spray capillary of the sprayer, and the nebulising gas may be supplied to a second capillary that may (at least partially) coaxially surround the central capillary. The arrangement of the capillaries, the flow rate of the solvent and/or the flow rate of the gas may be configured such that solvent droplets are ejected from the sprayer. The high voltage may be applied to the central spray capillary, e.g. such that the ejected solvent droplets are charged. Suitable connectors may therefore be provided on the housing allowing connections to be made to one or more of: (i) an electrical power supply; (ii) a supply of solvent gas; and (iii) a supply of nebulising gas;

The charged droplets may be directed at the sample such that subsequent ejected (secondary) droplets carry desorbed analyte ions. The ions may travel into an atmospheric pressure interface of an analytical instrument such as a mass and/or ion mobility spectrometer, e.g. via a transfer capillary.

According to the DESI technique a spray of charged droplets is directed towards the sample. However, in other embodiments where a sprayer device is used, the spray droplets need not be charged. For example, the sprayer device may alternatively (or additionally) be configured to perform sonic spray ionisation. In this case, the sprayer device may be supplied with a solvent and nebulising gas but a voltage source may not be required.

In embodiments, the spray capillary of the sprayer device may be positioned behind a nozzle or shield. That is, the first device may comprise a sprayer device comprising a spray capillary for generating a pneumatic spray of solvent droplets; and a nozzle or shield having an aperture, wherein the spray capillary is arranged to direct the spray of solvent droplets through the aperture (i.e. towards a sample to be analysed).

The nozzle or shield may thus protect the relatively fragile components of the spray capillary in use. The aperture may also allow for improved focussing of the spray (or e.g. for desorption electro-flow focussing ionisation ('DEFFI') techniques to be implemented). The nozzle or shield may take any suitable from as desired. However, in embodiments the nozzle or shield may have a generally conical or frustoconical shape.

The nozzle or shield may be maintained at ground potential. However, it is also contemplated that the nozzle or shield may be charged. For example, a voltage may be provided to the nozzle or shield to charge (or further charge) the solvent spray as it passes through the nozzle or shield (e.g. instead of, or in addition to, applying a voltage to the spray capillary). A voltage applied to the nozzle or shield may also be used to direct (or focus) the solvent spray as it passes through the nozzle or shield. The use of such a nozzle or shield may therefore allow for a highly charged, focussed, sampling spot to be created (e.g. suitable for surface imaging or sampling applications). The voltage may be provided by a suitable voltage source. Where a voltage is also applied to the spray capillary, this may use the same voltage source. Thus, suitable connections and internal wiring may be provided for connecting the nozzle or shield to a (or the) voltage source.

Thus, according to another aspect of the present disclosure, there is provided a sprayer device (such as a DESI sprayer device) comprising a spray capillary for generating a pneumatic spray of solvent droplets; and a nozzle or shield having an aperture through which the pneumatic spray of solvent droplets is directed, wherein a voltage is applied to the nozzle or shield to electrostatically charge or direct the spray of solvent droplets as the spray passes through the aperture.

The size of the aperture provided within the nozzle or shield may generally be selected as desired, e.g. depending on the desired spot size and the diameter of the spray capillary. In embodiments, the size of the aperture may range from about 10 microns to about 250 microns. For example, the size of the aperture may range from about: (i) 50 microns to about 250 microns; (ii) 100 microns to about 250 microns; (iii) 150 microns to about 250 microns; or (iv) 175 microns to about 250 microns.

In use, the first device acts to liberate analyte material from a certain region of the sample and the sampling inlet acts to collect the analyte material generated by the first device. The sampling inlet is thus generally positioned relative to the first device in order to achieve this. The sampling inlet may therefore generally point towards the same sampling spot or position as the first device. The source unit may thus comprise a "sampling surface" i.e. the surface that is intended to be positioned adjacent to (or pointed towards) a sample in use. That is, in use, the sampling surface of the source unit effectively corresponds to the surface of the sample that is being analysed. For instance, the first device generally acts to focus energy towards a sampling spot which may be focussed within the plane of the sampling surface.

In general, the position of the first device within the housing (where this is fixed) may be fixed at any suitable and desired angle relative to the sampling surface. For instance, in general, the optimal position of the first device within the housing may vary depending on the application. The optimal position may therefore be selected or determined e.g. based on prior calibration experiments. However, it has been found that angles of between about 45 and 90 degrees relative to the sampling surface of the source unit may be appropriate. For example, in embodiments, the first device may be positioned at a fixed angle relative to the sampling surface of the source unit within the range of about: (i) 45 to 90 degrees; (ii) 60 to 90 degrees; (iii) 60 to 80 degrees; or (iv) 70 to 80 degrees.

As mentioned above, the sampling inlet may generally point towards the same sampling spot or position as the first device. For instance, the sampling inlet may be fixed at an angle of between about 0 and 45 degrees relative to the sampling surface (measured in the opposite sense to the angle of the first device). For example, the sampling inlet may be fixed at angle of less than about: (i) 30 degrees; (ii) 20 degrees; or (iii) 15 degrees relative to the sampling surface. For instance, for some imaging experiments, an angle of about 10 degrees may suitably be used. For 'point-and-click' type surface sampling experiments (e.g. at airport security), the sampling inlet may suitably be fixed at a lower angle.

The sampling inlet may e.g. be an orifice of a sampling capillary. That is, the source unit may comprise a first device and a sampling capillary wherein the sampling capillary is arranged to collect analyte material liberated from the surface of a sample by the first device.

A voltage may be applied to the sampling inlet. This may help increase the sampling efficiency of the (charged) analyte material generated by the first device.

In embodiments, the sampling inlet may be heated (although it need not be). For instance, the sampling inlet may be heated at or to a temperature of above about 200° C., such as a temperature of above about: (i) 250° C.; (ii) 300° C.; (iii) 350° C.; or (iv) 400° C. The sampling inlet may be heated at or to a temperature between about 300 and 1000° C., such as between about 300 and 600° C. or between about 500 and 600° C.

Analyte material that is collected or received by the sampling inlet may then be transferred from the ambient ionisation source unit towards an inlet of an ion analysis instrument such as a mass and/or ion mobility spectrometer. Thus, a suitable connector may be provided on the housing for interfacing the sampling inlet with an inlet of an ion analysis instrument such as a mass and/or ion mobility spectrometer. For instance, a connector may be provided on the housing for connecting suitable transfer tubing for transferring analyte material collected by the sampling inlet towards an inlet of an ion analysis instrument such as a mass and/or ion mobility spectrometer.

The housing may generally take any suitable form as desired. For example, although other arrangements are of course possible, the housing may generally comprise a substantially rectangular cuboid. In embodiments, the first device and/or sampling inlet may protrude through a (sampling) surface of the housing. However, it is also contemplated that the first device and/or sampling inlet may be fully contained within the housing. In this case, a recess or channel may be provided on a (sampling) surface of the housing and the first device and/or sampling inlet may be located within the recess or channel. Thus, the sampling surface (i.e. the 'lower' surface that is brought into proximity with the sample to be analysed) may have a substantially flat or level profile i.e. so that no components protrude beyond the surface (avoiding the possibility for components to catch on edges of glass slides, samples, etc.).

By enclosing the first device and inlet within a housing the effect of atmospheric contaminants may be reduced. For instance, in embodiments, when the source unit is held adjacent a sample, a localised sampling volume may be defined. Thus, in embodiments, the source unit may define, in use, a local sampling volume. In other words, a substantially enclosed sampling volume may be defined by the housing (or e.g. a recess or channel of the housing) in combination with the surface of the sample to be analysed. It will be appreciated that the local conditions within this sampling volume may be relatively well-defined compared to open atmospheric conditions. For example, the sampling volume may be flooded with nitrogen, or with another suitable gas, in order to provide a controlled atmosphere.

Thus, by creating a localised sampling volume that is flooded with a suitable gas the effect of atmospheric contaminants or variations in the atmospheric conditions may be reduced. That is, by enclosing the first device and sampling capillary within a housing, the effect of atmospheric contaminants and other variations in the conditions can be reduced. Accordingly, in embodiments, the local sampling volume may be provided with a gas such as nitrogen.

The housing may also comprise suitable connectors allowing for the various voltages, gases, and solvents (e.g. where a sprayer device is used) to be provided to the ambient ionisation source unit. For instance, where the first device comprises a sprayer device, the housing may comprise a gas connector for introducing the nebuliser gas, a solvent connector for introducing the solvent, and (optionally) an electrical connector for providing a voltage to the spray capillary (and/or nozzle or shield, or sampling inlet) e.g. for charging the solvent droplets. Similarly, where the first device comprises a laser or plasma device, the housing may contain suitable connections for providing a laser or plasma beam to the ambient ionisation source unit.

In general (in use) the ambient ionisation source unit may be connected via transfer tubing (e.g. one or more transfer tube(s)) to an ion analysis instrument such as a mass and/or ion mobility spectrometer so that analyte material generated using the first device is collected by the sampling inlet and transferred via the transfer tubing towards an inlet of the ion analysis instrument.

The transfer tubing may comprise one or more flexible regions for accommodating movement of the ambient ionisation source unit relative to the ion analysis instrument. For instance, one or more flexible regions may be provided for accommodating vertical movement of the source unit above the sample (e.g. to accommodate different sample thicknesses). The one or more flexible regions may be provided at any position along the transfer tubing. It is also contemplated that (substantially) the entire transfer tubing may be flexible. For example, by providing a suitable length of flexible transfer tubing, the source unit may be used as a handheld analysis probe that can freely be brought into proximity with a surface that is desired to be analysed in order to provide a 'point-and-click' type analysis.

In embodiments, the transfer tubing may comprise a heated portion or may be heated (instead of or in addition to any optional heating of the sampling inlet within the housing). For instance, this may facilitate desolvation of the liberated analyte material.

For instance, in embodiments, the transfer tube may comprise a (first) flexible portion and a (second) heated portion.

The transfer tubing may generally comprise one or more transfer tubes. The transfer tubing generally comprises flexible tubing. For example, the transfer tube may suitably be formed from Tygon®, although various other arrangements would of course be possible.

Thus, according to a further aspect of the present disclosure, there is proved an ion analysis system comprising an ion analysis instrument such as a mass and/or ion mobility spectrometer; an ambient ion source unit substantially as described herein in relation to any of the aspects or embodiments of the disclosure; and transport tubing for transport analyte material from the sampling inlet of the ambient ion source unit to an inlet of the mass spectrometer so that the analyte material can be analysed by the mass spectrometer.

The relatively robust nature of the source units described herein as well as the reduced requirement for manual optimisation may lend itself, at least in some embodiments, to automated surface (or tissue) sampling systems. Thus, in embodiments, the ion analysis system may comprise an automated surface (or tissue) sampling system. In this case, a robotic platform may be provided for moving the ambient ionisation source unit relative to the sample.

Because the geometry of the first device and/or inlet is fixed relative to the housing, so that the positions of these cannot be adjusted by a user, the ambient ionisation source unit may instead be controlled by controlling various other (non-geometric) parameters of the first device (or sampling inlet). For instance, where the first device comprises a sprayer device, such as a DESI device, the device may be controlled by suitably adjusting the nebulising gas pressure, gas flow, spray capillary voltage and so on. Typically, these parameters may be controlled using suitable control circuitry and may therefore be set centrally by the instrument depending on the operating mode. Thus, there is still no need for manual user interaction as can be controlled using the control circuitry of the ion analysis instrument to which the ambient ionisation source unit is connected. For instance, the control circuitry may be controlled by software of the ion analysis instrument, which may be pre-configured for various applications.

Thus, the ion analysis system may further comprise control circuitry for controlling an adjustable supply of a nebulizing gas and/or a liquid solvent to the sprayer device. In embodiments, the control circuitry may control the pressure at which the nebulizing gas is provided to the sprayer device and/or the flow rate at which the solvent is provided to the sprayer device. Particularly, the nebulizing gas pressure and/or the solvent flow rate may be controlled within the ranges described above.

This control can be carried out in any desired and suitable manner. For example, the control circuitry can be implemented in hardware or software, as desired. Thus, for example, the control circuitry may comprise a suitable processor or processors, controller or controllers, functional units, circuitry, processing logic, microprocessor arrangements, etc., that are operable to perform the various functions, etc., such as appropriately dedicated hardware elements (processing circuitry) and/or programmable hardware elements (processing circuitry) that can be programmed to operate in the desired manner.

In embodiments, analyte material liberated from the surface of the sample may be caused to impact upon a surface so as to generate analyte ions. For example, analyte material may be transported from the sample to the collision surface using flexible transfer tubing. The collision surface may be located within a vacuum chamber of an analytical instrument.

From another aspect there is provided a method of manufacturing an ambient ionisation source unit comprising providing a housing, a first device and a sampling inlet (or capillary); and mounting the first device and sampling inlet within the housing so that the position of the first device and/or sampling inlet is fixed relative to the housing. The source unit may then be installed onto (i.e. connected to) an ion analysis instrument such as mass and/or ion mobility spectrometer.

It will be appreciated that the ambient ionisation source unit manufactured according to this method may generally, and in embodiments does, comprise any of the features described above.

Also disclosed herein are various methods of ion analysis using an ambient ionisation source unit substantially as described herein. For instance, in some embodiments, a method of imaging may be provided. In this case, the ambient ionisation source unit may be configured for performing an imaging experiment. The ambient ionisation source unit may then be connected to an ion analysis instrument. In other embodiments, a method of surface sampling is provided.

Accordingly, from another aspect there is provided a method of producing ions from a sample comprising generating analyte material from a surface of the sample using a first device; and collecting the analyte material liberated from the surface of the sample using a sampling inlet, wherein the first device and sampling inlet are contained within a housing and wherein the position(s) of the first device and/or sampling inlet is fixed relative to the housing.

Generating analyte material from the surface of the sample may comprise directing a spray of droplets onto the sample. In other embodiments, generating analyte material from the surface of the sample may comprise directing a laser beam or plasma beam onto the sample. It will be appreciated that the configuration of the first device, sampling inlet and the housing may comprise any of the features of any of the other aspects or embodiments described herein.

From a further aspect there is provided an apparatus for producing ions from a sample comprising: a first device configured to direct a spray of droplets or a laser beam onto a sample; and an inlet configured to collect the analyte from the sample; wherein the first device and the inlet are integrated into a single sampling head or probe. The first device (e.g. sampling probe) may thus comprise a sprayer device or a laser probe substantially as described above.

The apparatus according to this aspect may generally comprise any or all of the features described herein in relation to any of the aspects or embodiments described herein.

BRIEF DESCRIPTION OF THE DRAWINGS

Various embodiments will now be described, by way of example only, and with reference to the accompanying drawings in which.

DETAILED DESCRIPTION

Various examples of an ambient ionisation source unit will now be described.

Figure 1:
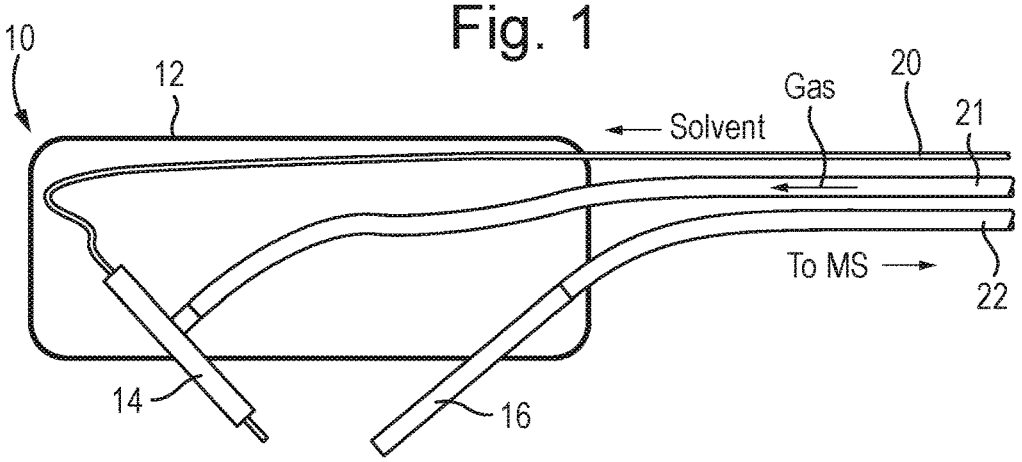
FIG. 1 shows schematically an example of a source unit in accordance with various embodiments.

FIG. 1 shows an example of an ambient ionisation source unit 10 in accordance with an embodiment of the present disclosure. The ambient ionisation source unit 10 comprises a first device that is configured to generate analyte material from a sample and a sampling capillary 16 integrated into a single housing 12. The first device comprises a sampling probe 14 which may generally comprise any suitable and desired ambient ionisation probe. For example, in embodiments, the sampling probe may comprise a laser ablation or plasma desorption probe. However, in FIG. 1, the sampling probe 14 is in the form of a desorption electrospray ionisation ('DESI') sprayer device that acts to direct a spray of solvent droplets onto the surface of a sample that is to be analysed. The source unit 10 may be connected to an analytical instrument via one or more flexible tubes e.g. which may comprise a liquid (solvent) supply tube 20, a gas supply tube 21, and a transfer tube 22 for transporting analyte material towards the inlet of the analytical instrument.

Figure 2:
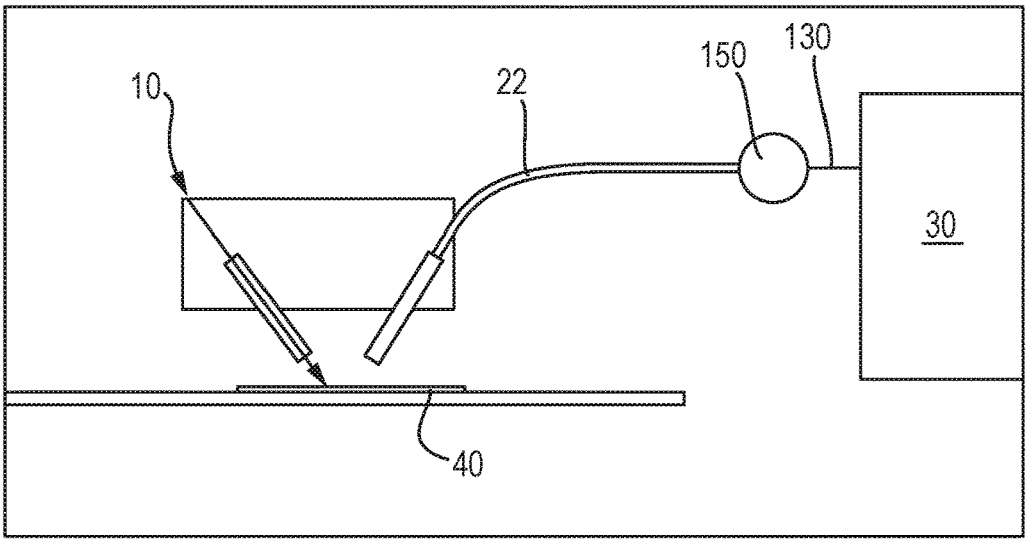
FIG. 2 shows schematically an example of a mass spectrometry system comprising a source unit of the type shown in FIG. 1.

FIG. 2 shows an example of an ion analysis system wherein an ambient ionisation source unit 10 of the type shown in FIG. 1 is connected to the front end of an analytical instrument such as a mass spectrometer 30. As shown, the source unit 10 is positioned above a sample 40 and the sampling probe 14 is used to direct a spray of droplets onto the surface of the sample 40. The solvent droplets act to desorb analyte material from the surface of the sample. The analyte material that is liberated (desorbed) from the sample 40 by the sampling probe 14 is then collected by a sampling inlet of a sampling capillary 16 and transferred towards an atmospheric pressure inlet 130 of an ion analysis instrument 30 such as a mass and/or ion mobility spectrometer via suitable transfer tubing 22.

Optionally, as shown in FIG. 2, an organic solvent such as isopropanol is added to the analyte material liberated from the surface of the sample prior to the atmospheric pressure inlet 130 of the instrument 30. This may be done by a suitable solvent dosing device 150. However, the addition of an organic solvent is not essential.

Figure 3:
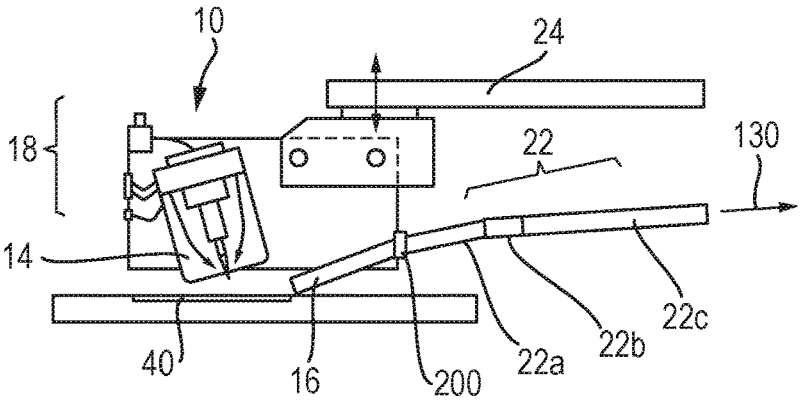
FIG. 3 shows schematically another example of a mass spectrometry system in accordance with various embodiments.

FIG. 3 shows another example of an ambient ionisation source unit 10 in accordance with an embodiment of the present disclosure. As shown, a connector 200 is provided on the housing 12 that allows for suitable transfer tubing 22 to be connected to the housing so that the ambient ionisation source unit 10 may be readily installed onto the front-end of the ion analysis instrument 130. Various other connectors 18 are also provided for allowing the housing 12 to be connected to suitable supplies of solvent and nebulising gas, and also for connecting the housing to a voltage source.

The positions of the sampling probe 14 and sampling capillary 16 are both fixed within the housing in a predetermined (e.g. optimal) geometry. Thus, the only geometrical degree of freedom available to the user is the height of the ambient ionisation source unit 10 above the sample surface. In FIG. 3 the height of the ambient ionisation source unit 10 above the sample surface is controlled by an adjustable vertical stage 24. Thus, as shown, the transfer tubing 22 comprises a flexible region 22A that allows the transfer tubing 22 to flex to accommodate the vertical movement of the ambient ionisation source unit 10. The flexible region 22A is then connected via a suitable connector 22B to a further (heated) region 22C leading to the inlet of the ion analysis instrument. However, various other arrangements are of course possible. For instance, in embodiments, substantially the entire length of transfer tubing 22 may be flexible. The transfer tubing may be formed from Tygon® or other suitable materials.

Figure 4:
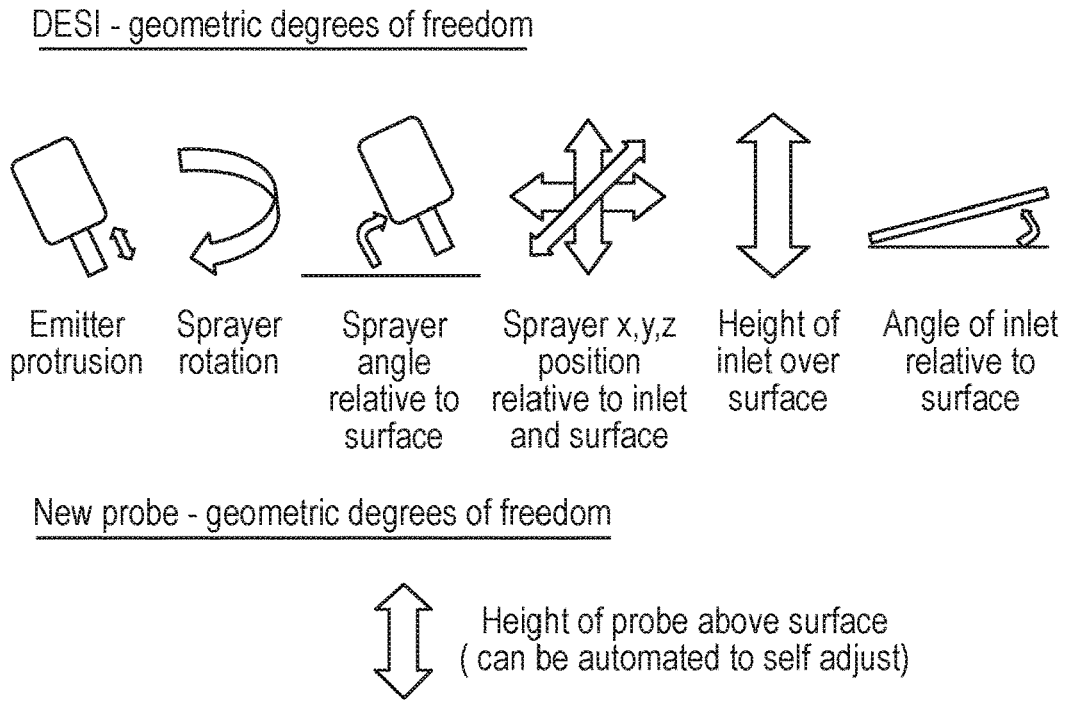
FIG. 4 shows schematically the reduction in geometric degrees of freedom that may be provided in accordance with various embodiments.

FIG. 4 illustrates the reduction in geometric degrees of freedom that is offered by the fixed geometry ambient ionisation source unit compared to a conventional DESI source. In a conventional DESI sources, the user would have to manually set and optimise the positions, angles and rotations of both the sprayer and capillary relative to the sample surface. This can be a very time consuming and difficult task. Furthermore, this may lead to a lack of reproducibility between experiments, e.g. performed in different laboratories. It is believed that this has presented a significant barrier towards greater uptake of DESI techniques despite the potential advantages offered thereby. By contrast, for a fixed geometry ambient ionisation source unit the only remaining geometric degree of freedom is the height of the probe above the surface.

Figure 5:
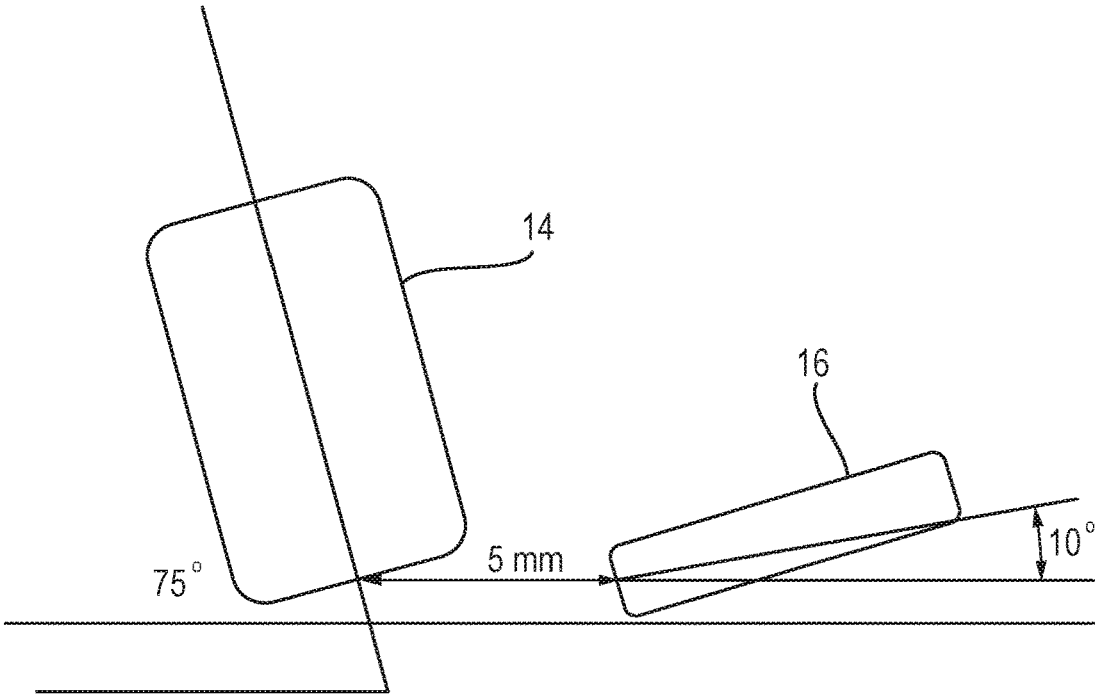
FIG. 5 illustrates an example of the optimal physical parameters of the ambient ionisation source unit in accordance with various embodiments.

FIG. 5 shows one example of an optimal geometry (determined from repeated experiments on adjustable DESI systems) wherein the sprayer device 14 is positioned at an angle of about 75 degrees to the horizontal (i.e. to the surface of the sample when the source unit is held parallel to the sample) whereas the sampling capillary 16 is angled at about 10 degrees to the horizontal. The spacing between the sprayer device 14 and the sampling inlet 16 is about 5 mm. However, it will be appreciated that other geometries may suitably be used depending on the application and the user's requirements. For example, when the source unit is used as a handheld analysis probe e.g. for point-of-contact applications, the sampling capillary 16 may be angled closer to the horizontal, e.g. at less than 10 degrees to the horizontal.

Figure 6:
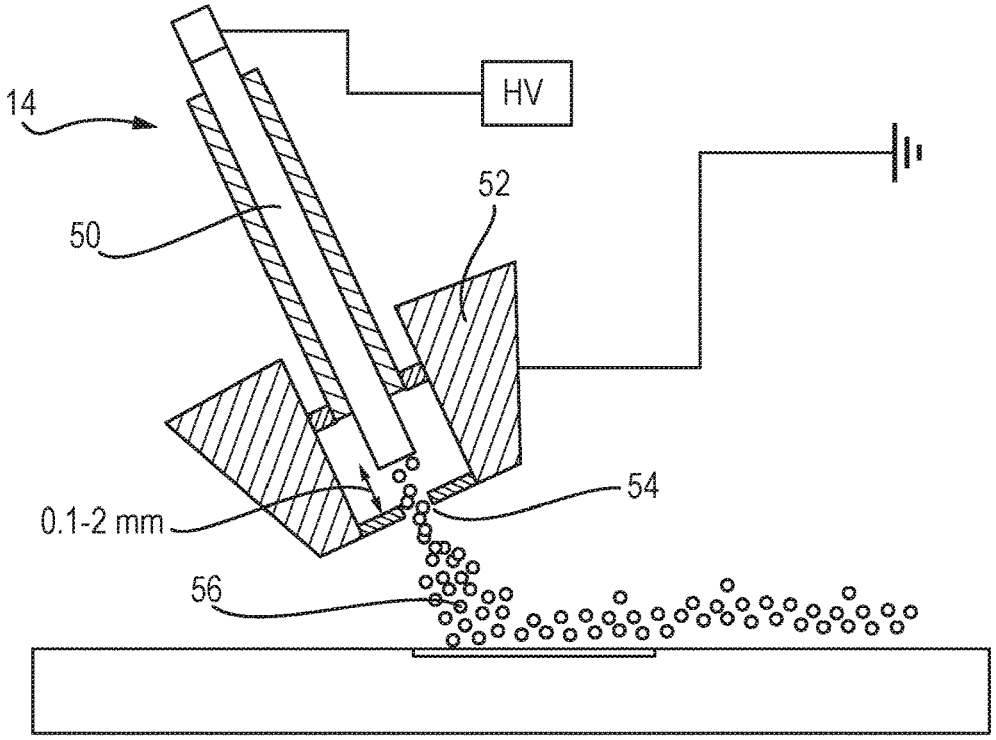
FIGS. 6 & 7 show examples of sprayer devices that may be used in accordance with various embodiments described herein.

FIG. 6 shows further details of a DESI sprayer device 14 that may be used according to various embodiments described herein. In general, a DESI sprayer device comprises a spray capillary 50 for generating a pneumatic spray of solvent droplets. Solvent is introduced into the spray capillary 50 which is then nebulised at the exit of the capillary by a nebulising gas flow (not shown) provided around the capillary 50. The spray of solvent droplets 56 that is generated can thus be directed onto the sample surface in order to liberate analyte material according to known desorption ionisation processes.

Figure 7:
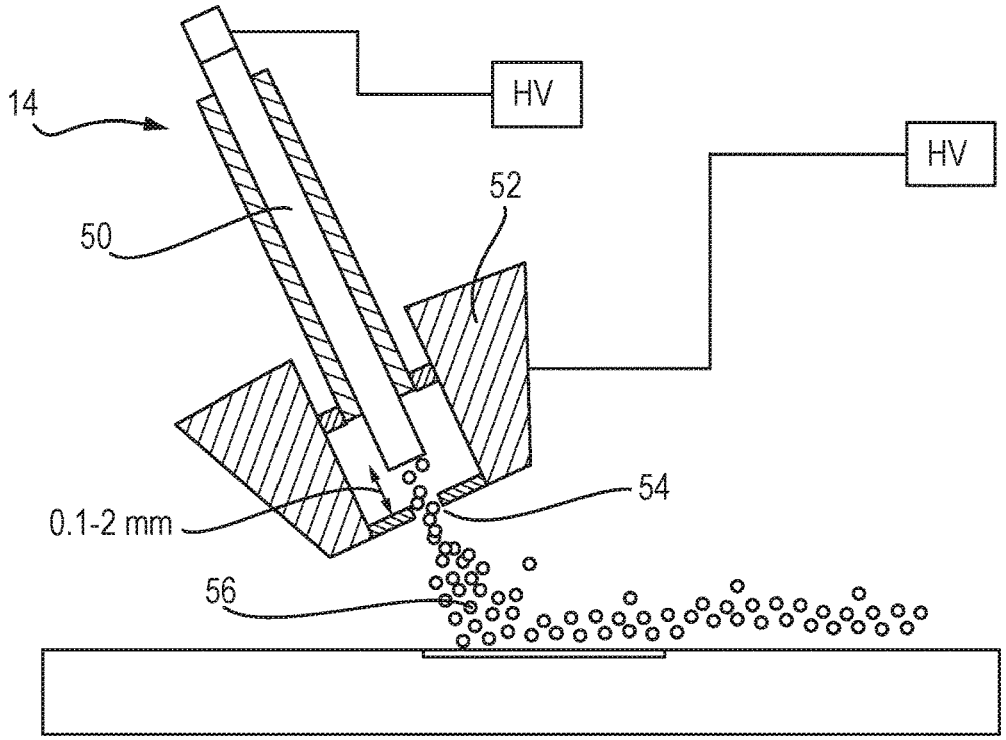

Thus, in order to generate the solvent spray 56, a liquid solvent is fed into the spray capillary alongside a high velocity nebulizing gas flow so that the nebulizing gas acts to nebulize the solvent exiting the spray capillary. A voltage may be applied to the DESI sprayer, or to the flow of liquid solvent, in order to charge the solvent droplets. The charged solvent may thus be pneumatically driven by the gas flow from the spray capillary onto the sample surface. The DESI sprayer thus directs a spray of charged solvent droplets onto the sample surface. Although an electrospray-type sprayer has been described, it will be appreciated that various suitable devices that are capable of generating a stream of solvent droplets carried by a jet of nebulizing gas may be used to form the spray of (charged) solvent droplets. For instance, although FIGS. 6 and 7 illustrate a DESI-MS interface, various similar solvent-driven ionisation interfaces have been developed and are known that operate according to similar physical principles to DESI and to which the techniques of the present invention may also be extended. For instance, by way of one example, Desorption ElectroFlow focussing ionisation ("DEFFI") sources may also suitably by used to generate the analyte ions. Particularly, it is also contemplated that the solvent may not be charged in the sprayer device, as described above, but rather that the droplets of solvent may subsequently be activated or charged after their deposition onto the sample. For example, a voltage may be applied to the tissue section substrate to provide the charges.

In any case, the solvent droplets (whether charged or not) impact on and interest with the surface of the sample in order to generate analyte ions. There are understood to be two main kinds of ionisation mechanism for DESI analyses, which may depend e.g. on the nature of the sample and the operating conditions of the DESI sprayer.

The first main ionisation mechanism is via a desorption process wherein the solvent droplets hit the surface of the sample and then spread out over a larger diameter and act to dissolve the analyte material with the dissolved analyte material then being released from the surface generating analyte ions as the solvent is evaporated. For example, the droplets may form a thin film of solvent on the surface of the sample that desorbs the analyte molecules, and the desorbed analyte may then be released as secondary droplets by vaporisation or due to the impact of further solvent droplets on the sample. This may result in similar spectra to conventional electrospray ionisation ("ESI") techniques wherein primarily multiply charged ions are observed. It is believed that this mechanism leads to more multiply charged ions because multiple charges in the solvent droplets may easily be transferred to the desorbed analyte molecules. This mechanism may also be referred to as the "droplet pick-up"

ionisation mechanism. This ionisation mechanism may be particularly suited for the ionisation and analysis of larger molecules such as peptides and proteins.

The second main ionisation mechanism is via direct charge transfer, either between a solvent ion and an analyte molecule on the surface of the sample; or between gas phase ions and analyte molecules on the surface or in the gas phase. This mechanism may be similar to what is observed in easy ambient sonic spray ionisation ("EASI") techniques, and typically generates only singly charged ions. This mechanism is normally observed for relatively smaller or lower molecular weight species compared to the desorption mechanism described above.

It will be understood that these techniques, including DESI, are generally "ambient" ionisation techniques. That is, the sample may be maintained and analysed under ambient or atmospheric conditions. Ambient ionisation ion sources such as DESI sources may further be characterised by their ability to generate analyte ions from a native or unmodified sample. For example, this is in contrast to other types of ionisation ion sources such as Matrix Assisted Laser Desorption Ionisation ("MALDI") ion sources that require a matrix or reagent to be added to prepare the sample prior to ionisation. It will be apparent that the requirement to add a matrix or a reagent to a sample impairs the ability to provide a rapid simple analysis of target material. Ambient ionisation techniques such as DESI are therefore particularly advantageous since firstly they do not require the addition of a matrix or a reagent and since secondly they enable a rapid simple analysis of target material to be performed. Ambient ionisation techniques such as DESI do not generally require any prior sample preparation or offline sample pre-treatment or separation. As a result, the various ambient ionisation techniques enable tissue samples to be analysed without necessitating the time and expense of adding a matrix or reagent to the tissue sample or other target material.

In other words, ambient ionisation techniques such as DESI may allow for a substantially direct analysis of the sample, i.e. without requiring any specific offline sample preparation or separation steps to be performed prior to the analysis. It will be appreciated that in the context of ambient ionisation the meaning of "direct" analysis is a well understood term of the art referring to in situ analyses performed directly from the surface of a sample. Direct analyses may thus avoid the need for any time-consuming sample separation or off line preparation steps e.g. using a matrix. Particularly, ambient ionisation techniques such as DESI may allow for samples to be directly analysed essentially in their native form. Naturally, this does not preclude any other steps that do not significantly alter the sample such as steps of washing the sample or mounting the sample. Furthermore, it is also contemplated that the sample may be treated with an enzyme such as protease in order to instigate digestion of the tissue, as explained further below, with the digested tissue then being analysed directly.

As shown in FIG. 6, the spray capillary 50 is located behind a nose cone (or shield) 52 with the spray capillary 50 located in-line with an aperture 54 provided in the nose cone 52 such that the solvent spray 56 is directed from the spray capillary 50 through the apertures 54 onto the sample surface. The nose cone 52 may thus act to protect the spray capillary 50, which may be relatively fragile (e.g. comprising fused silica). The aperture may also provide some focussing of the solvent spray 56. The nose cone 52 may be grounded as shown in FIG. 4A. As shown in FIG. 6, the spray capillary tip is positioned between about 0.1 and 2 mm behind the aperture. In some examples, a 200 micron aperture is used in combination with a 360 micron (OD) and 75 micron (ID) fused silica spray capillary. However, it is envisaged that a range of different combinations may suitably be used.

FIG. 7 shows an alternative arrangement wherein the nose cone 52 is also connected to a high voltage (HV) source. Although shown in FIG. 7 as comprising separate high voltage (HV) sources for the nose cone 52 and the spray capillary 50, in general, these voltages may both be applied from a single (external) voltage source, e.g. via a suitable connector provided on the housing, with suitable internal wiring or circuitry being provided within the housing to provide the desired voltage to each of the different components. The nose cone 52 may thus be maintained at a certain voltage e.g. to provide additional electrostatic charging or focussing of the spray droplets (e.g. for DESI operation). In other embodiments, a voltage may only be applied to the nose cone 52 (and not the spray capillary 50), so that the solvent droplets are charged only as the pass through the aperture.

In some cases, the spray droplets may not be charged at all.

According to various embodiments described herein, the geometric parameters of the sampling unit may be substantially optimised and then fixed to minimise the required user interaction. The source unit may thus be controlled by carefully controlling the (other, non-geometric) ionisation or instrument parameters. For instance, where the source unit comprises a DESI probe, as described above, the ionisation may be controlled by adjusting e.g. the nebulising gas pressure, solvent flow, and so on. It will be appreciated that these parameters may be controlled directly from the instrument, or control software, so that, again, the requirement for the user to spend significant time optimising the set-up is avoided.

For example, at least for some tissue imaging experiments, the following operating ranges and optimal parameter values have been determined (although naturally other parameters may be suitably used e.g. depending on the application and the details of the instrument being used):

| Parameter | Operating Range | Optimum |
|---|---|---|
| Gas pressure | 1 to 10 bar | 4 bar |
| Solvent flow | 0.05 to 10 μL/min | 2 μL/min |
| Solvent voltage | 0 to 5 kV | 2.5 kV |
| Capillary temperature | 0 to 600° C. | 550° C. |

Other potential suitable operating parameters for DESI sources are described in United Kingdom Patent Application No. 1708835.2 filed on 2 Jun. 2017, which is incorporated herein by reference.

Figure 8:
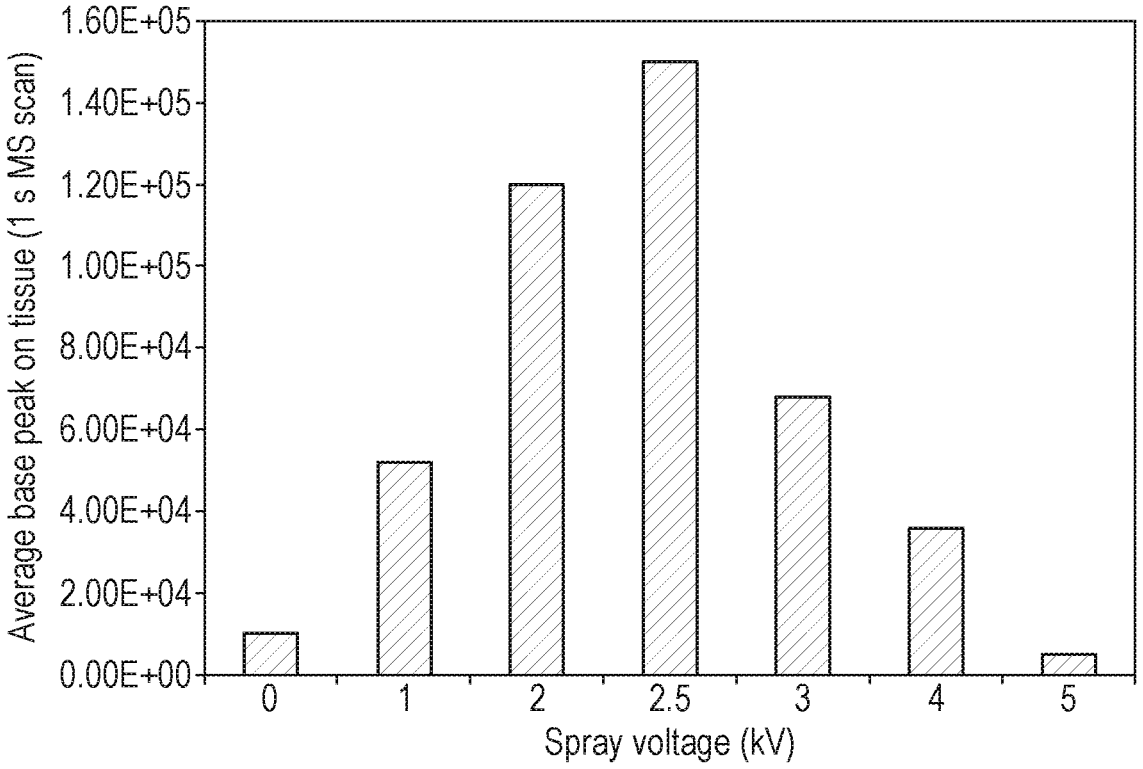
FIG. 8 shows an example of base peak intensities for lipid species obtained from a tissue section illustrating the effect of spray capillary voltage.

For instance, FIG. 8 shows the effect of varying the spray voltage on base peak intensities of lipid species from tissue section with a remote acquisition of 2.5 metres transfer tubing. As shown, there is a clear optimal voltage at about 2.5 kV where a stable spray through the aperture is set up.

Figure 9:
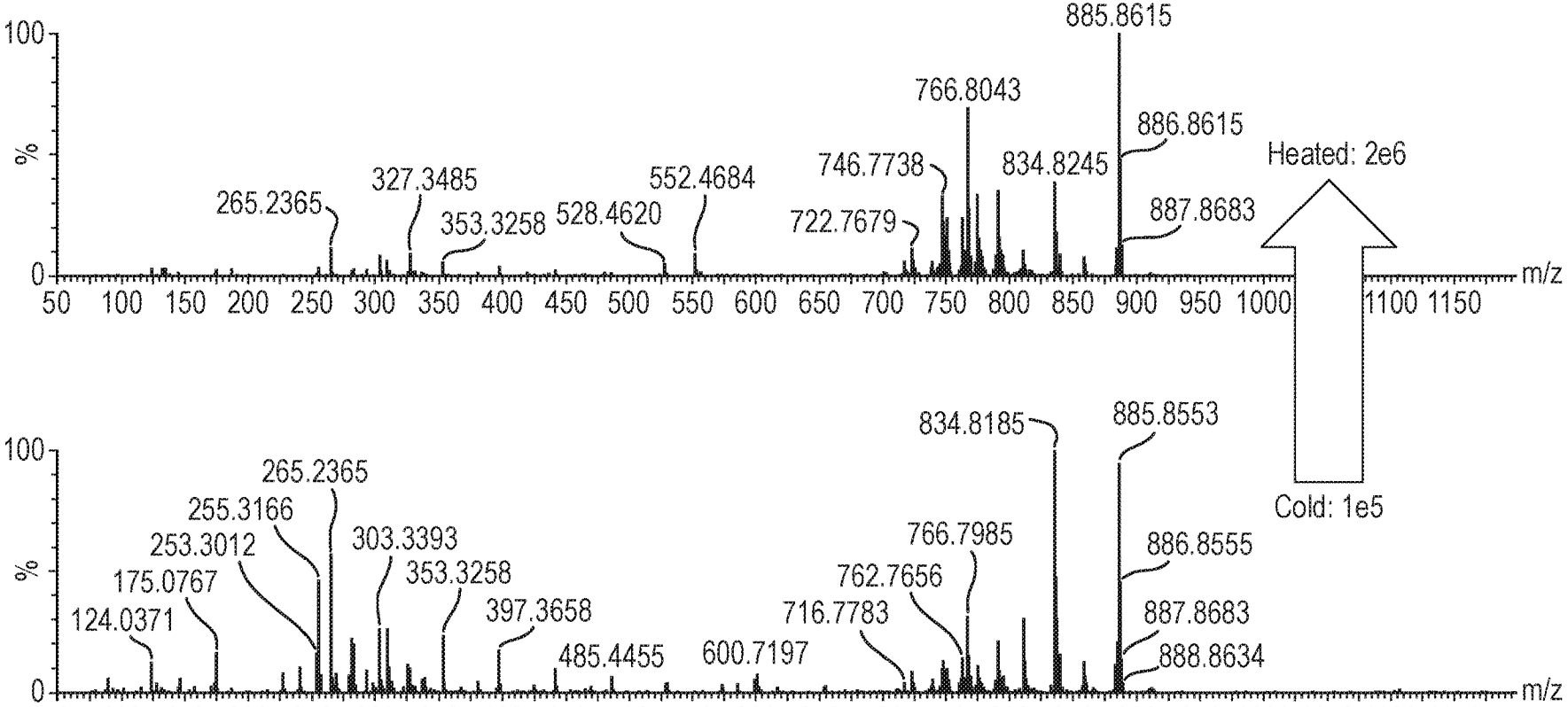
FIG. 9 illustrates the effects of heating a portion of the inlet path on the robustness and signal intensity.

FIG. 9 illustrates the effects of heating the transfer tubing. As shown, heating the final portion of the transfer tubing (i.e. that leading into the inlet of the mass spectrometer) may increase robustness and signal intensity by helping to control the evaporation of droplets prior to their arrival at the inlet/source of the ion analysis instrument. As shown in FIG. 9, when the transfer tubing 22 comprises a heated portion 22C, the signal intensity may be increased by an order of magnitude compared the same system without heating.

Figure 10:
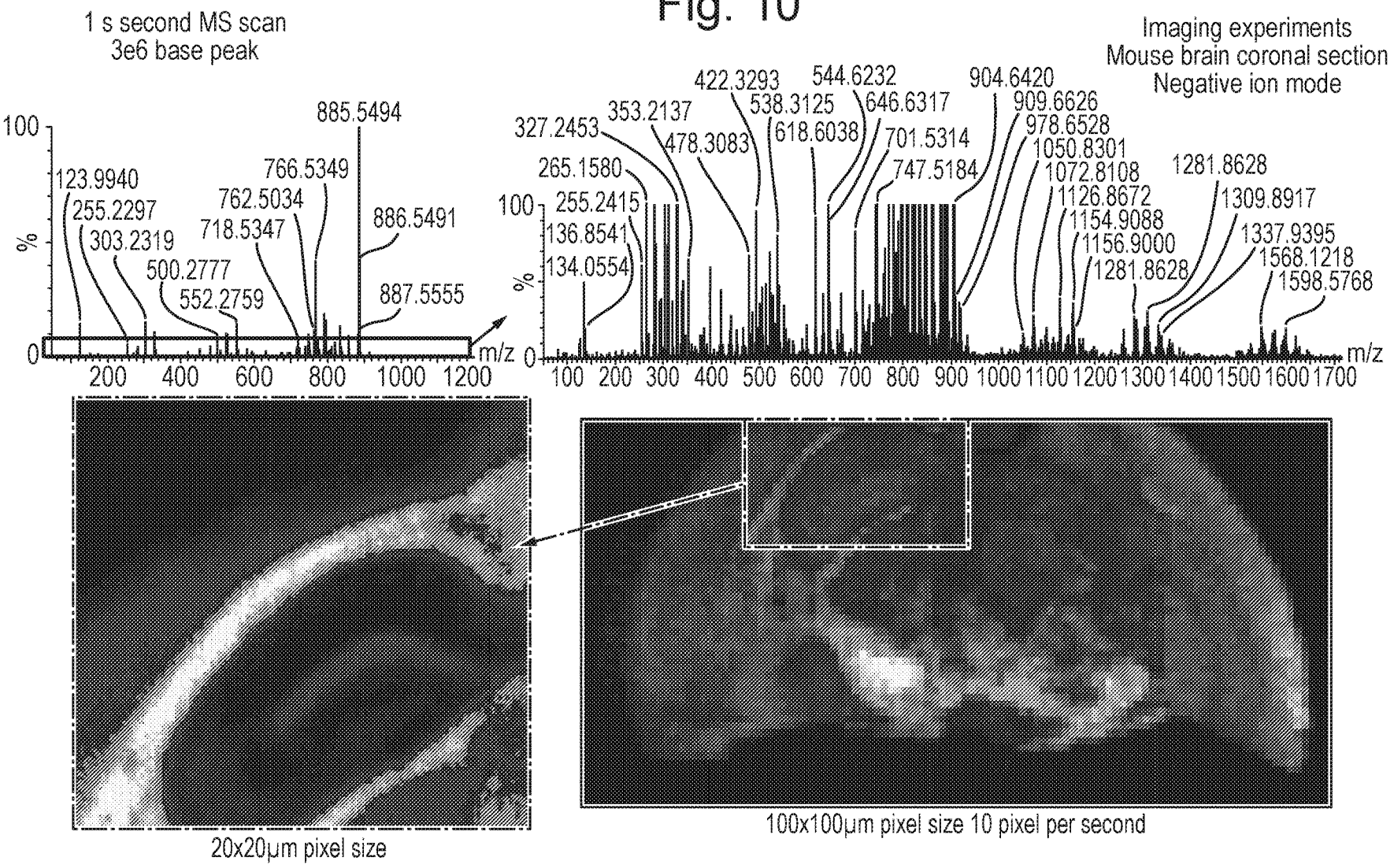
FIG. 10 illustrates exemplary data that may be obtained using a source unit according to various embodiments described herein.

In both cases (whether or not heating is applied), the fixed geometry probe allows for significant improvement in signal intensity compared to conventional DESI. For instance, FIG. 10 shows an example of tissue imaging results that may be obtained with the configuration described above. As shown, the signal intensity is high and the spatial resolution is comparable to what could be achieved with conventional DESI. Thus, the use of the combined ambient ionisation source probe described herein may help to remove user involvement in obtaining high quality data from an ambient ionisation sampling experiment.

Figure 11:
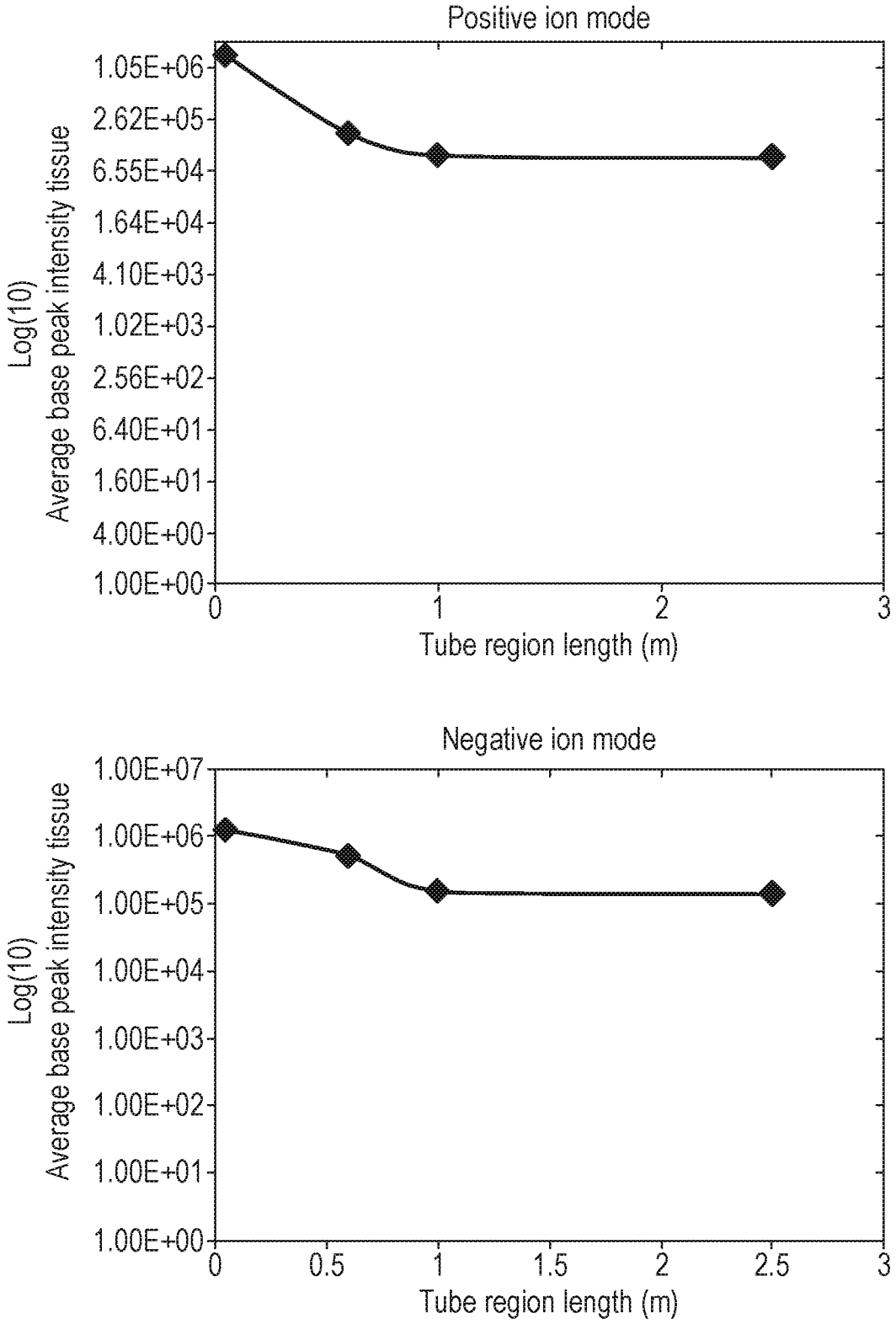
FIG. 11 shows the effect of the length of transfer tubing on signal intensity in both positive and negative ion modes.

The length of the transfer tubing can easily be varied. FIG. 11 illustrates the effects of varying the length of the transfer tubing for both positive and negative ion modes of operation. (In general, the ambient ionisation ion system may be operated in negative ion mode or positive ion mode. However, the Applicants have found that better classification accuracy can generally be achieved using negative ionisation mode. Thus, according to various embodiments generating analyte ions from the sample using ambient ionisation comprises using ambient ionisation in negative ionisation mode.) As shown, after an initial drop in intensity from adjacent acquisition (~2 centimetres) to remote acquisition (~60 centimetres), there is no further significant loss of signal intensity up to a transfer length of 2.5 metres. Such a system may thus allow the sampling device (i.e. source unit) to be decoupled from the analyser, increasing the flexibility of use as many of the physical constraints are removed.

The housing may generally take any suitable and desired form. For instance, although illustrated in the figures above as comprising a substantially cuboid form, it will be appreciated that the form of the housing may take any suitable and desired form. The sampling probe and capillary may be fully contained within the housing or may protrude through a lower surface. Both options are shown in FIG. 12.

Figure 12:
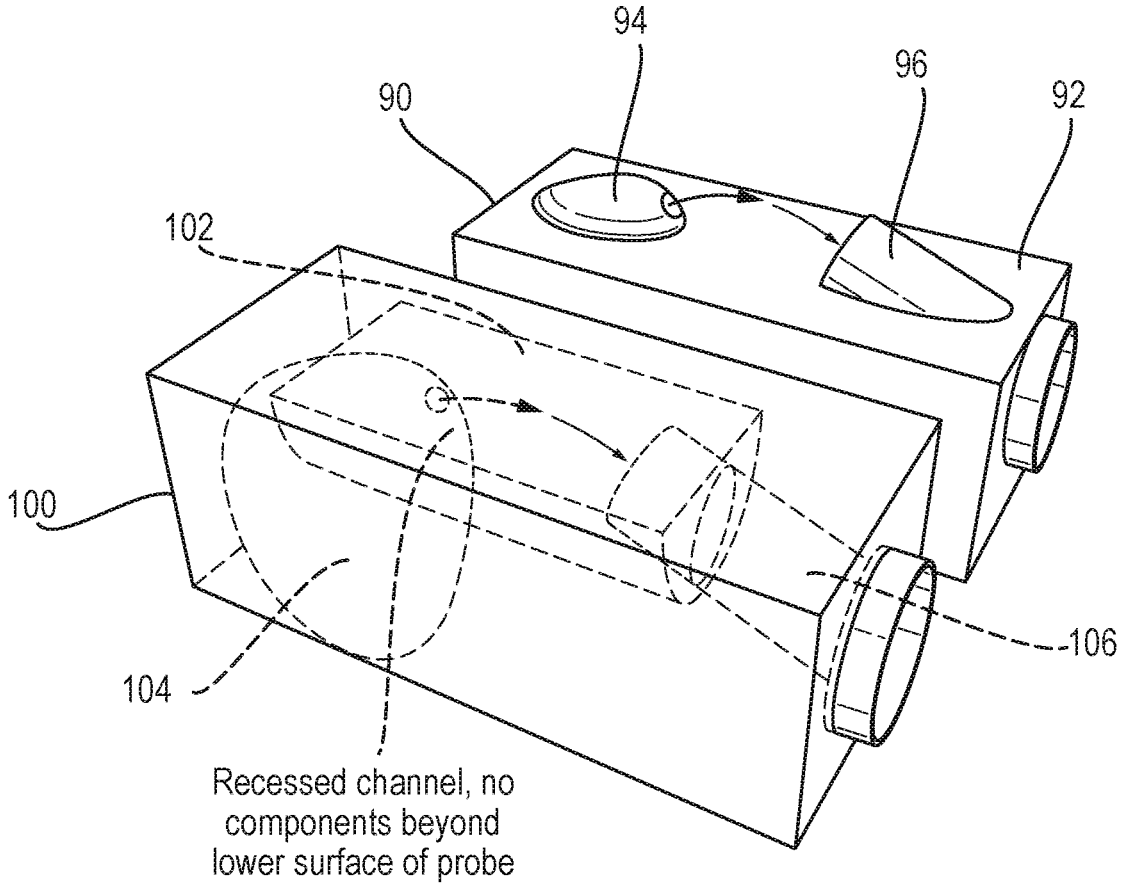
FIG. 12 show two possible designs of source units in accordance with various embodiments.

FIG. 12 shows two possible designs for a source unit. In the first (top) design, the sampling probe 94 and sampling inlet 96 protrude through a surface 92 of the housing 90. This may help allow the sampling probe 94 and inlet 96 to be brought very close to a sample.

In the second (bottom) design, the sampling probe 104 and capillary 106 are fully contained within the housing 100. Thus, as shown, the sampling probe 104 and capillary 106 are recessed into the body of source unit. In this case, the combination can still generally be brought close enough (e.g. ~1 millimetre above) to a sample for optimal sampling but there are now no protruding components, which may otherwise be problematic.

Because of the lack (or protection of) fragile parts such as the DESI emitter and the lack of any need for manual optimisation, the source units described herein may be particularly suitable for integration into automated surface or tissue sampling systems. For instance, the source unit may be integrated into an automated imaging system.

For example, for the system shown in FIG. 3 the position (height) of the ambient ionisation source unit 10 above the sample may be automatically controlled using the vertical stage 24 (e.g. in combination with a horizontal stage for moving the sample 30 underneath the ambient ionisation source unit 10) in order to automatically probe or image a sample. One or more sensors may be provided that are configured to determine the presence (or absence) and/or location of a sample (or the presence (or absence) and/or location of a product of which the sample is part) to be analysed. The one or more sensors may comprise, for example, one or more (e.g. mechanical) sensors configured to determine the presence of a sample (product) when its weight or another force caused by the sample (product) is detected. It would also or instead be possible for the one or more sensors to utilise, for example, image recognition techniques, etc.

Figure 13:
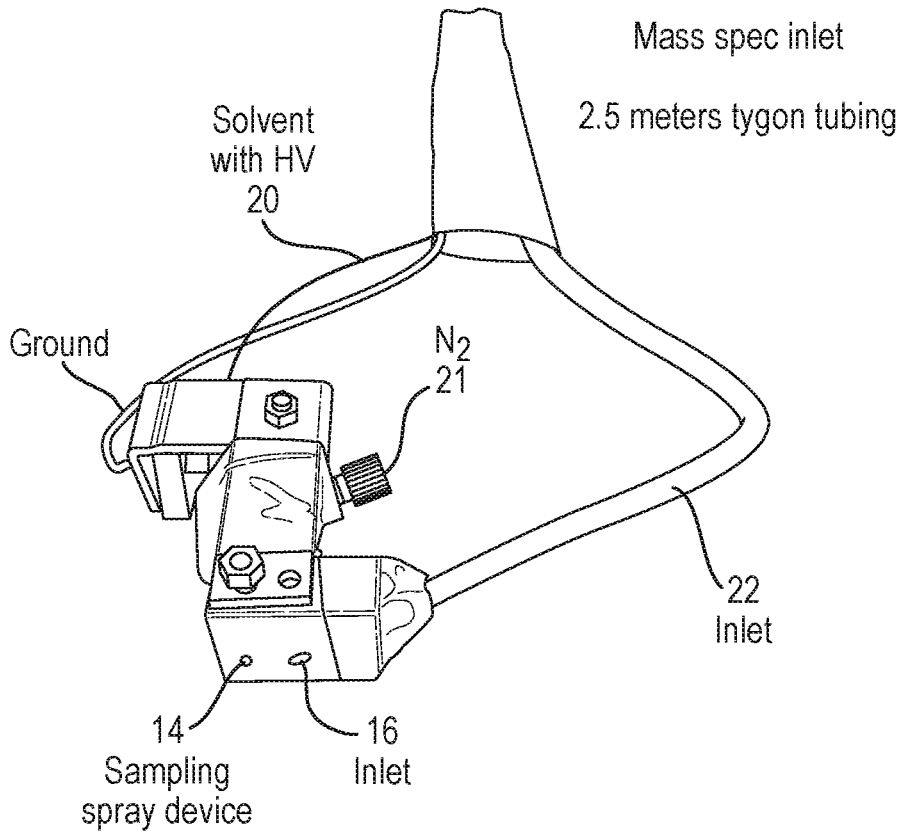
FIG. 13 shows a prototype of a handheld sampling probe in accordance with various embodiments.

However, various other arrangements are of course possible. For instance, the source unit may be provided at the end of a relatively long transfer tubing (e.g. greater than 2 metres) so that the source unit can be used as a handheld analysis probe that can be manually brought into close contact with a sample by the user. FIG. 13 shows an example of a prototype handheld sampling unit incorporating a source unit of the type described herein. In FIG. 13 the transfer tubing connecting the sampling probe to the mass spectrometer inlet comprises 2.5 metres of Tygon tubing. However, it will be appreciated that the length and material of the transfer tubing may be adjusted as desired, e.g. depending on the application. FIG. 13 also shows the various connections to the sampling probe.

Although the examples described above relate to particularly to DESI systems, it will be appreciated that the features described herein may in general relate to various types of (ambient) ionisation sources. For instance, various DESI-derived techniques have been developed and the techniques presented herein may be applied equally to these.

Figure 14:
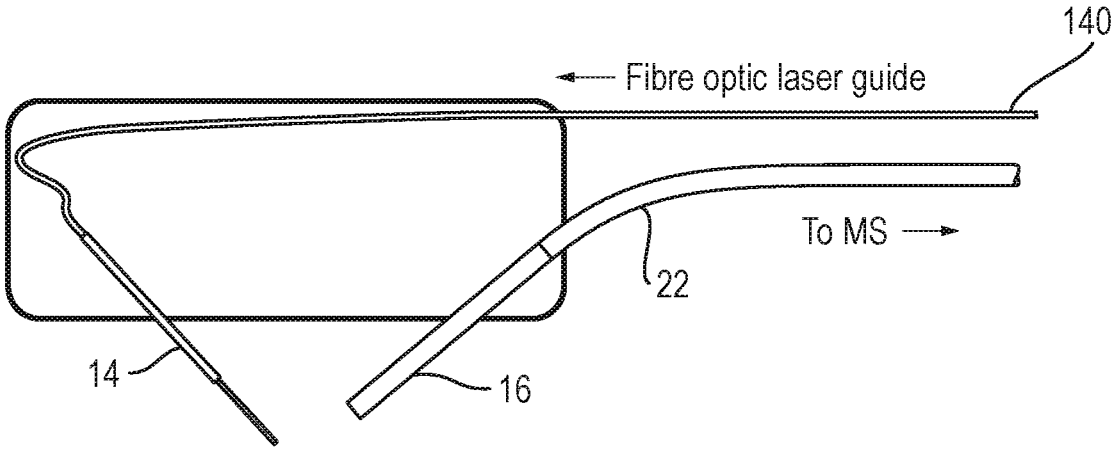
FIG. 14 shows schematically an example of a source unit incorporating a laser probe.

In other examples, the sampling probe may comprise a laser ablation or plasma desorption probe. For example, FIG. 14 shows an example of another ambient ionisation source unit 10 in accordance with an embodiment wherein the sampling probe 14 comprises a laser probe. As shown, a fibre optic laser guide 140 is provided externally to the housing. The sampling probe 14 thus acts to direct the laser beam onto the surface of the sample in order to ablate analyte material from the surface thereof. The ablated analyte material can thus be collected by the sampling inlet 16 and transported by flexible transfer tube 22 towards the inlet of an analytical instrument such as a mass spectrometer.

In general, the sampling probe may alternatively, or additionally, comprise any of: (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electroflow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a focussed or unfocussed ultrasonic ablation device; (xxii) a microwave resonance device; or (xxiii) a pulsed plasma RF dissection device.

Although the present invention has been described with reference to preferred embodiments, it will be understood by those skilled in the art that various changes in form and detail may be made without departing from the scope of the invention as set forth in the accompanying claims.

The invention claimed is:

1. An ambient ionisation source unit comprising:

a housing containing a first device for generating analyte material from a surface of a sample to be analysed and a sampling inlet for receiving analyte material liberated from the surface of the sample, wherein the first device comprises a sprayer device comprising a spray capillary for generating a pneumatic spray of solvent droplets;

wherein the position of the first device is fixed relative to the housing; and wherein the sampling inlet is adjustable relative to the housing between two or more discrete positions;

wherein the ambient ionisation source unit is connected via transfer tubing to an ion analysis instrument so that analyte material generated using the first device is collected by the sampling inlet and transferred via the transfer tubing towards an inlet of the ion analysis instrument, wherein the transfer tubing comprises one or more flexible regions for accommodating movement of the ambient ionisation source unit relative to the ion analysis instrument.

2. The source unit of claim 1, wherein the first device comprises an ambient ionisation probe.

3. The source unit of claim 1, wherein the first device comprises a desorption electrospray ionisation ("DESI") or DESI-derived sprayer device.

4. The source unit of claim 1, wherein the first device comprises a nozzle or shield having an aperture, wherein the spray capillary is arranged to direct the spray of solvent droplets through the aperture.

5. The source unit of claim 4, wherein the nozzle or shield is grounded or wherein a voltage is applied to the nozzle or shield to electrostatically charge or direct the solvent droplets as the spray of solvent droplets passes through the aperture.

6. The source unit of claim 1, wherein the first device and sampling inlet are recessed into the housing so that the first device and sampling inlet do not protrude or extend beyond the housing.

7. The source unit of claim 1, wherein the first device and/or sampling inlet protrude through or extend beyond a surface of the housing.

8. The source unit of claim 1, wherein the source unit is a handheld source unit.

9. The source unit of claim 1, wherein the source unit defines, in use, a local sampling volume, and optionally wherein the local sampling volume is provided with a gas such as nitrogen.

10. The source unit of claim 1, wherein a voltage is applied to the sampling inlet.

11. The source unit of claim 1, wherein the housing comprises one or more connectors for allowing connections to be made to one or more of: (i) an electrical power supply; (ii) a supply of solvent gas; (iii) a supply of nebulising gas; and (iv) transfer tubing for transferring analyte material collected by the sampling inlet towards an inlet of an ion analysis instrument.

12. The source unit of claim 1, wherein the transfer tubing comprises a heated portion or is heated.

13. An ion analysis system comprising:

an ion analysis instrument such as a mass and/or ion mobility spectrometer;

an ambient ionisation source unit as claimed in claim 1;

wherein the transport tubing transports analyte material from the sampling inlet of the ambient ion source unit to an inlet of the mass spectrometer so that the analyte material can be analysed by the mass spectrometer.

14. An apparatus for producing ions from a sample comprising:

a first device configured to direct a spray of droplets or a laser beam onto a sample; and an inlet configured to collect the analyte from the sample;

wherein the first device and the inlet are integrated into a single sampling head or probe;

wherein the position of the first device is fixed relative to the housing; and wherein the sampling inlet is adjustable relative to the housing between two or more discrete positions;

wherein the ambient ionisation source unit is connected via transfer tubing to an ion analysis instrument so that analyte material generated using the first device is collected by the sampling inlet and transferred via the transfer tubing towards an inlet of the ion analysis instrument, wherein the transfer tubing comprises one or more flexible regions for accommodating movement of the ambient ionisation source unit relative to the ion analysis instrument.

* * * * *